United States Patent [19]

Abdelgawad et al.

[11] Patent Number: 4,942,887

[45] Date of Patent: Jul. 24, 1990

[54] FILTER MOUTHPIECE FOR A SMOKING ARTICLE

[75] Inventors: Ahmed Abdelgawad, Colombier; Daniel Braem, Doffrane; Urs Nyffeler, Corcelles, all of Switzerland

[73] Assignee: Fabriques de Tabac Reunies, S.A., Nuechatel, Switzerland

[21] Appl. No.: 204,546

[22] Filed: Jun. 9, 1988

[30] Foreign Application Priority Data

Jun. 15, 1987 [GB] United Kingdom ..... 8713904

[51] Int. Cl.[5] ..... A24D 3/04

[52] U.S. Cl. ..... 131/336; 131/339

[58] Field of Search ..... 131/336, 331, 338, 339, 131/340, 341

[56] References Cited

U.S. PATENT DOCUMENTS

| | | | |
|---|---|---|---|
| 346,025 | 7/1986 | Cook . | |
| 1,437,956 | 12/1922 | Blair . | |
| 1,945,207 | 1/1934 | Thomas | 131/52 |
| 2,349,551 | 5/1944 | Helm | 131/8 |
| 2,695,617 | 10/1954 | Warnberg | 131/10 |
| 2,827,903 | 3/1958 | Niederman | 131/10 |
| 2,888,935 | 6/1959 | Eissmann | 131/94 |
| 2,918,922 | 12/1959 | Eissmann | 131/10 |
| 2,954,773 | 10/1960 | Lebert | 131/10 |
| 2,954,778 | 10/1960 | Lebert | 131/187 |
| 2,954,785 | 10/1960 | Lebert | 131/189 |
| 2,958,328 | 11/1960 | Bartolomeo | 131/9 |
| 2,979,058 | 4/1961 | Schur | 131/10 |
| 3,045,680 | 7/1962 | Smith | 131/10 |
| 3,059,649 | 10/1962 | Bernhard | 131/10 |
| 3,219,040 | 11/1965 | Chun Kon Kim | 131/8 |
| 3,242,925 | 3/1966 | Sterne | 131/10 |
| 3,270,750 | 9/1966 | Campbell | 131/10 |
| 3,324,862 | 6/1967 | De Simone | 131/10.5 |
| 3,347,245 | 10/1967 | Hawkins | 131/10.7 |
| 3,349,776 | 10/1967 | Bell et al. | 131/8 |
| 3,356,094 | 12/1967 | Ellis et al. | 131/266 |
| 3,389,705 | 6/1968 | Levavi | 131/10.5 |
| 3,428,050 | 2/1969 | Kandel | 131/10.3 |
| 3,438,381 | 4/1969 | Hale | 131/267 |
| 3,490,461 | 1/1970 | Osmalov et al. | 131/10.5 |
| 3,496,946 | 2/1970 | Griffith | 131/10.5 |
| 3,502,087 | 3/1970 | Romano | 131/261 |
| 3,533,416 | 10/1970 | Berger et al. | 131/266 |
| 3,546,325 | 12/1970 | Muller | 264/47 |
| 3,596,664 | 8/1971 | Pinkham | 131/10.5 |
| 3,599,646 | 8/1971 | Berger et al. | 131/265 |
| 3,605,756 | 9/1971 | Stewart | 131/10.5 |
| 3,612,064 | 10/1971 | Woods | 131/10.5 |
| 3,614,956 | 10/1971 | Thornton | 131/10.5 |
| 3,621,851 | 11/1971 | Heskett et al. | 131/10.5 |
| 3,628,540 | 12/1971 | Sherrill | 131/10.5 |
| 3,628,543 | 12/1971 | Bemont | 131/207 |

(List continued on next page.)

FOREIGN PATENT DOCUMENTS

| | | |
|---|---|---|
| 0077123 | 4/1983 | European Pat. Off. . |
| 1298029 | 6/1969 | Fed. Rep. of Germany . |
| 1446636 | 6/1965 | France . |
| 74/3645 | 6/1974 | South Africa . |
| 682696 | 11/1952 | United Kingdom . |
| 1083761 | 9/1967 | United Kingdom . |
| 1470857 | 4/1977 | United Kingdom . |
| 2012554 | 8/1979 | United Kingdom . |
| 2078487 | 1/1982 | United Kingdom . |
| 2091078 | 7/1982 | United Kingdom . |
| 2135865 | 9/1984 | United Kingdom . |
| 2161362 | 1/1986 | United Kingdom . |
| 2166937 | 5/1986 | United Kingdom . |
| 2172186 | 9/1986 | United Kingdom . |
| 2177890 | 2/1987 | United Kingdom . |

*Primary Examiner*—V. Millin

*Attorney, Agent, or Firm*—Jeffrey H. Ingerman

[57] ABSTRACT

A filter mouthpiece for a smoking article comprises a rod end portion having a tube extending axially therethrough and a mouth end portion. The tube is open at each end and has perforations in its wall. The peripheral surface of the filter mouthpiece is rendered air permeable in at least one discrete area by means of perforations in an impermeable tipping, to admit air to the filter. When attached to a tobacco rod this filter mouthpiece provides a substantially constant dry particulate matter delivery throughout the smoking of the article.

15 Claims, 4 Drawing Sheets

U.S. PATENT DOCUMENTS

| | | | |
|---|---|---|---|
| 3,630,210 | 12/1971 | Haslam | 131/261 B |
| 3,631,864 | 1/1972 | Beard | 131/10.5 |
| 3,631,867 | 1/1972 | Beard | 131/261 B |
| 3,648,712 | 3/1972 | Patterson | 131/10.5 |
| 3,651,819 | 3/1972 | Beard | 131/261 B |
| 3,674,036 | 7/1972 | Vega | 131/7 |
| 3,685,523 | 8/1972 | Labbe | 131/261 B |
| 3,752,165 | 8/1973 | Harllee et al. | 131/10.5 |
| 3,756,249 | 9/1973 | Selke et al. | 131/9 |
| 3,756,250 | 9/1973 | Morgenstern | 131/10.3 |
| 3,768,489 | 10/1973 | Kiefer et al. | 131/261 B |
| 3,773,053 | 11/1973 | Stephens, Jr. | 131/9 |
| 3,774,622 | 11/1973 | Steigerwald | 131/9 |
| 3,789,855 | 2/1974 | Norman | 131/9 |
| 3,791,265 | 2/1974 | Westcott et al. | 93/1 C |
| 3,805,682 | 4/1974 | Lyon et al. | 93/1 C |
| 3,811,451 | 5/1974 | Berger | 131/10 R |
| 3,841,338 | 10/1974 | Horsewell et al. | 131/261 B |
| 3,847,161 | 11/1974 | Morgenstern | 131/10.3 |
| 3,854,384 | 12/1974 | Naylor | 93/1 C |
| 3,855,032 | 12/1974 | Luke | 156/201 |
| 3,860,011 | 1/1975 | Norman | 131/10.5 |
| 3,888,160 | 6/1975 | Westcott et al. | 93/1 C |
| 3,894,545 | 7/1975 | Crellin et al. | 131/261 B |
| 3,905,377 | 9/1975 | Yatrides | 131/9 |
| 3,910,288 | 10/1975 | Hammersmith et al. | 131/10.5 |
| 4,022,221 | 5/1977 | Berger | 131/10.5 |
| 4,022,222 | 5/1977 | Berger | 131/10.5 |
| 4,026,306 | 5/1977 | Berger | 131/10.5 |
| 4,027,679 | 6/1977 | Kaswan | 131/9 |
| 4,037,524 | 7/1977 | Hall | 93/77 FT |
| 4,086,846 | 5/1978 | Hall | 93/77 FT |
| 4,109,666 | 8/1978 | Norman et al. | 131/261 B |
| 4,116,602 | 9/1978 | Hall | 425/354 |
| 4,135,523 | 1/1979 | Luke et al. | 131/261 B |
| 4,179,323 | 12/1979 | Sigmon | 156/201 |
| 4,256,122 | 3/1981 | Johnson | 131/10 A |
| 4,273,141 | 6/1981 | Van Tilburg | 131/336 |
| 4,291,712 | 9/1981 | Koster et al. | 131/339 |
| 4,328,817 | 5/1982 | Naylor et al. | 131/360 |
| 4,331,166 | 5/1982 | Hale | 131/331 |
| 4,340,072 | 7/1982 | Bolt et al. | 131/273 |
| 4,342,322 | 8/1982 | Sanford | 131/336 |
| 4,343,319 | 8/1982 | Cantrell | 131/336 |
| 4,357,950 | 11/1982 | Berger | 131/338 |
| 4,362,171 | 12/1982 | Johnson et al. | 131/336 |
| 4,380,241 | 4/1983 | Horsewell | 131/336 |
| 4,386,618 | 6/1983 | Cantrell | 131/336 |
| 4,388,934 | 6/1983 | Luke | 131/339 |
| 4,393,885 | 7/1983 | Silberstein | 131/339 |
| 4,413,641 | 11/1983 | Dwyer, Jr. et al. | 131/361 |
| 4,438,776 | 3/1984 | Lamb et al. | 131/336 |
| 4,488,563 | 12/1984 | Morifuji et al. | 131/336 |
| 4,498,487 | 2/1985 | Frattolillo | 131/336 |
| 4,506,683 | 3/1985 | Cantrell et al. | 131/336 |
| 4,508,525 | 4/1985 | Berger | 493/43 |
| 4,515,170 | 5/1985 | Cantrell et al. | 131/336 |
| 4,527,572 | 7/1985 | Luke | 131/336 |
| 4,542,754 | 9/1985 | Cantrell et al. | 131/336 |
| 4,564,030 | 1/1986 | Jessup et al. | 131/336 |
| 4,580,584 | 4/1986 | Reynolds et al. | 131/336 |
| 4,582,072 | 4/1986 | Sanford | 131/336 |
| 4,583,560 | 4/1986 | Sakai et al. | 131/336 |
| 4,585,015 | 4/1986 | Silberstein | 131/339 |
| 4,593,707 | 6/1986 | Seidel et al. | 131/336 |
| 4,620,553 | 11/1986 | Bale et al. | 131/198.1 |

FILTER MOUTHPIECE FOR A SMOKING ARTICLE

BACKGROUND OF THE INVENTION

The present invention relates to an improved filter mouthpiece for a smoking article, such as a cigarette, in particular a filter mouthpiece having a hollow tube extending axially therethrough from one end towards, but not as far as, the other end, and to a cigarette provided with such a mouthpiece.

In a conventional cigarette, the resistance to draw and air ventilation, if any, of the combined tobacco rod and filter mouthpiece stay substantially the same throughout the smoking of the cigarette. This has the effect of increasing the dry particulate matter (DPM) delivery with successive puffs. Particularly, although not solely, in the case of low delivery cigarettes, so-called "low-tar cigarettes", this may be undesirable, since the first puff may be rather weak in taste and "impact" and, anyway, the taste and "impact" of the cigarette to the smoker will change as the cigarette is smoked.

It is known to vary the resistance to draw (RTD) of a cigarette by providing a filter mouthpiece having a hollow tube extending from the tobacco end thereof toward, but ending short of, the mouth end. When a cigarette provided with such a mouthpiece is smoked, smoke passes along the tube toward the mouth end and impinges on the filter material at the mouth end of the tube. Components of the smoke condense on the filter material adjacent the open mouth end of the tube, blocking the tube and causing at least some of the smoke to pass through the surrounding filter material, so increasing the resistance to draw of the cigarette. This has the effect of evening out to some extent the DPM delivery as smoking progresses.

It is also known to provide a tube having small slits along its length. This increases the resistance to draw the filter mouthpiece more gradually and results in more even DPM delivery than if a completely impervious tube is used. However, this arrangement still provides a cigarette in which the DPM delivery increases as the cigarette is smoked.

SUMMARY OF THE INVENTION

It is now surprisingly found that if a ventilated filter mouthpiece, that is one in which ambient air is admitted to the filter by means of, for example, perforate tipping, is provided with a perforate tube open at both ends, extending from the tobacco rod end of the filter toward but not so far as the mouth end of the filter, a cigarette may be made which, when smoked, displays a substantially constant DPM (dry particulate matter) delivery. If desired, the mouthpiece can be configured to provide an initially high DPM delivery, which rapidly drops to a lower level and maintains that lower level substantially throughout the smoking of the cigarette.

In one embodiment, ambient air is admitted to the filter through two separate places on the mouthpiece surface, one adjacent the tobacco rod end of the filter and one toward the mouth end, preferably adjacent the mouth end of the hollow tube.

A preferred arrangement is to provide a rod end filter portion abutting a mouth end filter portion, the first portion having a hollow tube extending therethrough, the walls of which are perforate. The two filter portions are overwrapped and are attached to a wrapped tobacco rod by a tipping, the tipping being air permeable in one or more discrete areas as described above.

It is particularly preferred that the lengths of the rod end and the mouth end filter portions be in the ratio of approximately 3:1. Preferred lengths are in the range of from 17 mm to 21 mm, particularly preferably 19 mm, for the rod end portion, and from 4 mm to 8 mm, particularly preferably 6 mm, for the mouth end portion.

The filter portions may be of cellulose acetate, crepe paper or other suitable materials, and the tube may be of cellulose acetate, poly propylene or other suitable material. Alternatively, the tube may be formed by a bore through the first filter portion, the walls of which are partially sealed, for example by heating, or completely sealed and subsequently perforated.

It is preferred that the hollow tube has about 6 or 7 pairs of holes along its length. The pairs or holes may be opposed or staggered. Alternatively, the tube may be permeable throughout its length.

Smoking articles, such as cigarettes, having filter mouthpieces according to the invention, are also provided.

BRIEF DESCRIPTION OF THE DRAWINGS

The invention will be further described, by way of example, with reference to the drawings, in which.

DETAILED DESCRIPTION OF THE INVENTION

Figure 1:
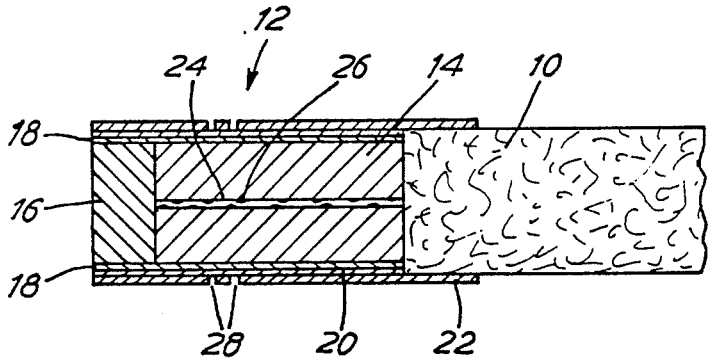
FIG. 1 shows a cross-section through a cigarette provided with a filter mouthpiece according to a first embodiment of the invention.

The cigarette of FIG. 1 comprises a wrapped tobacco rod 10 and a filter mouthpiece 12 according to the first embodiment of the invention. The filter mouthpiece 12 comprises a rod end filter portion 14 abutting and in co-axial alignment with the tobacco rod 10 and a mouth end filter portion 16 abutting and in co-axial alignment with the rod end portion 14. Both filter portions are wrapped with substantially air permeable wrapping 18. The filter portions 14, 16 are joined together by an air permeable overwrap 20 and to the tobacco rod 10 by a substantially air impermeable tipping 22.

The rod end filter portion 14 has an tube 24 running down its centre, the walls of which are perforated with holes 26, and the ends of which are open.

Preferably, six or seven diametrically opposed pairs of holes are provided down the length of the tube 24.

In the embodiment of FIG. 1, the tipping has perforations 28 through it in the region of the mouth end of the rod end filter portion 14.

Figure 2:
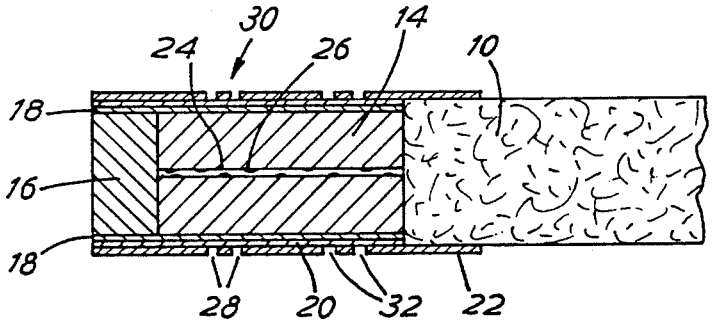
FIG. 2 shows a cross-section through a cigarette provided with a filter mouthpiece according to a second embodiment of the invention.

The cigarette of FIG. 2 comprises a cigarette rod 10 and a filter mouthpiece 30 according to the second embodiment of the invention.

This filter mouthpiece 30 is generally similar to that of FIG. 1, and like components have been indicated by like reference numerals. However, this filter has a second set of perforations 32 through the tipping 22 adjacent the rod end of the rod end filter portion 14.

| | | |
|---|---|---|
| Mouth end portion length | 4–8 mm, preferably 6 mm | |
| Rod end portion length | 17–21 mm, preferably 19 mm | |
| Filter diameter | 7–9 mm, preferably 7.85 mm | |
| Mouth end portion RTD | 15–30 mm, preferably 19 mm, water gauge | |
| Rod end portion RTD | 100–150 mm, preferably 123 mm, water gauge (when the tube is blocked by condensate) | |
| Tube internal diameter | 0.8–2 mm, preferably 1.1 mm | |
| Tube external diameter | 1–2.2 mm, preferably 1.3 mm | |
| Diameter of holes in tube | 0.2–0.4 mm, preferably 0.25 mm | |
| Portion of first (or only) zone of perforations | start | 9 mm from mouth end of filter |
| | end | 15 mm from mouth end of filter |
| Portion of second zone of perforations | start | 18 mm from mouth end of filter |
| | end | 22 mm from mouth end of filter |

When a cigarette provided with a filter mouthpiece according to the invention is smoked, smoke initially flows rapidly down the hollow tube 24 and impinges upon the second mouth end, filter portion 16 adjacent the opening of the tube. Some of the smoke condenses thereon, and eventually this condensate blocks the end of the tube. Smoke then flows out of the tube through the holes 26 therein nearest the mouth end, thus increasing the RTD of the filter. As the exits from those holes become blocked by condensate in the filter, the smoke leaves the tube through the next pair of holes and so on, the RTD of the filter increasing as the exit from each pair of holes is blocked.

The effect of this is to give a gradually increasing overall RTD, together with a gradually increasing degree of ambient air ventilation. This has the effect of giving a substantially constant DPM delivery, and thus a substantially constant taste to the smoker.

Figure 3:
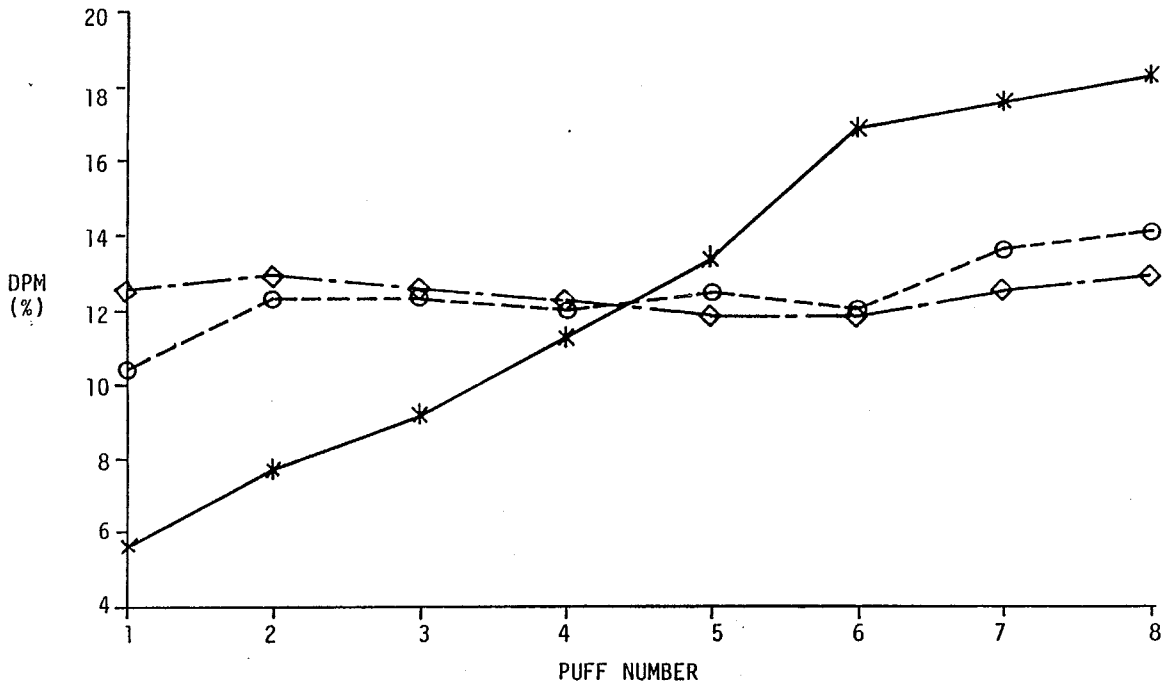
FIG. 3 shows a plot of DPM delivery against puff number for a standard cigarette (unbroken line) and two cigarettes having filter mouthpieces according to the first embodiment of the invention (broken and chain lines respectively)
Figure 4:
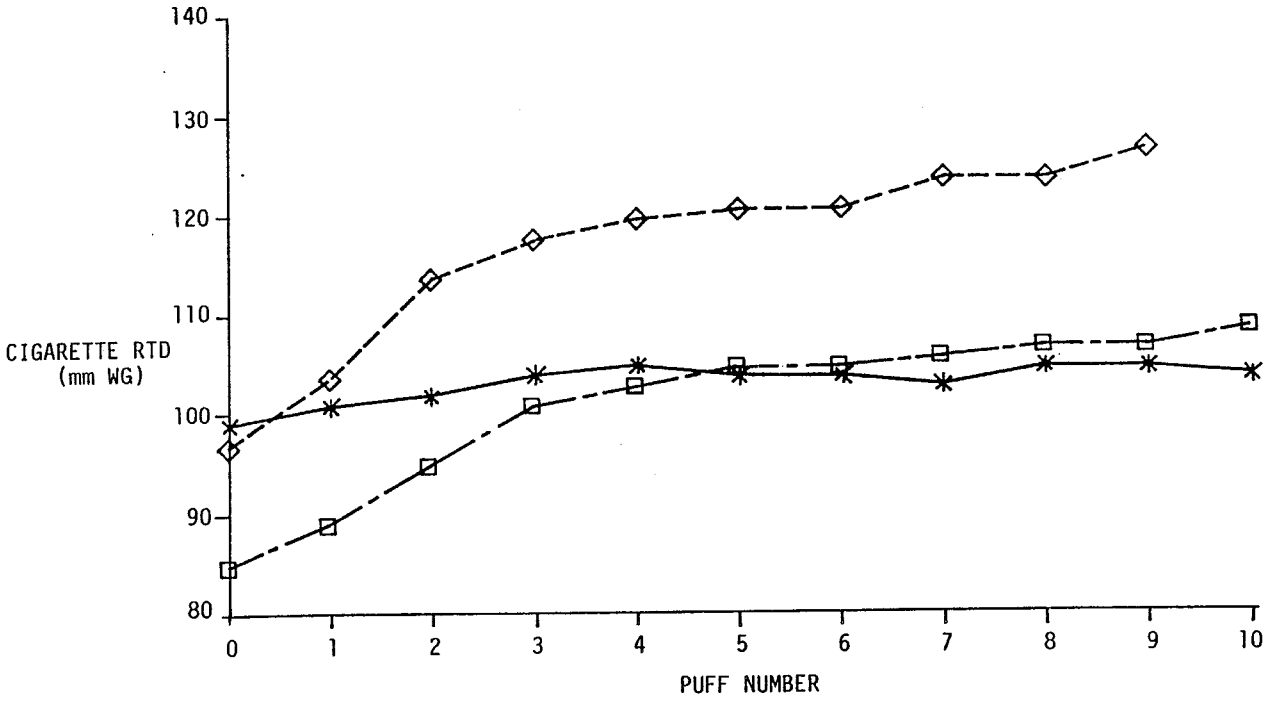
FIG. 4 shows a plot of RTD against puff number for the cigarettes of FIG. 3.
Figure 5:
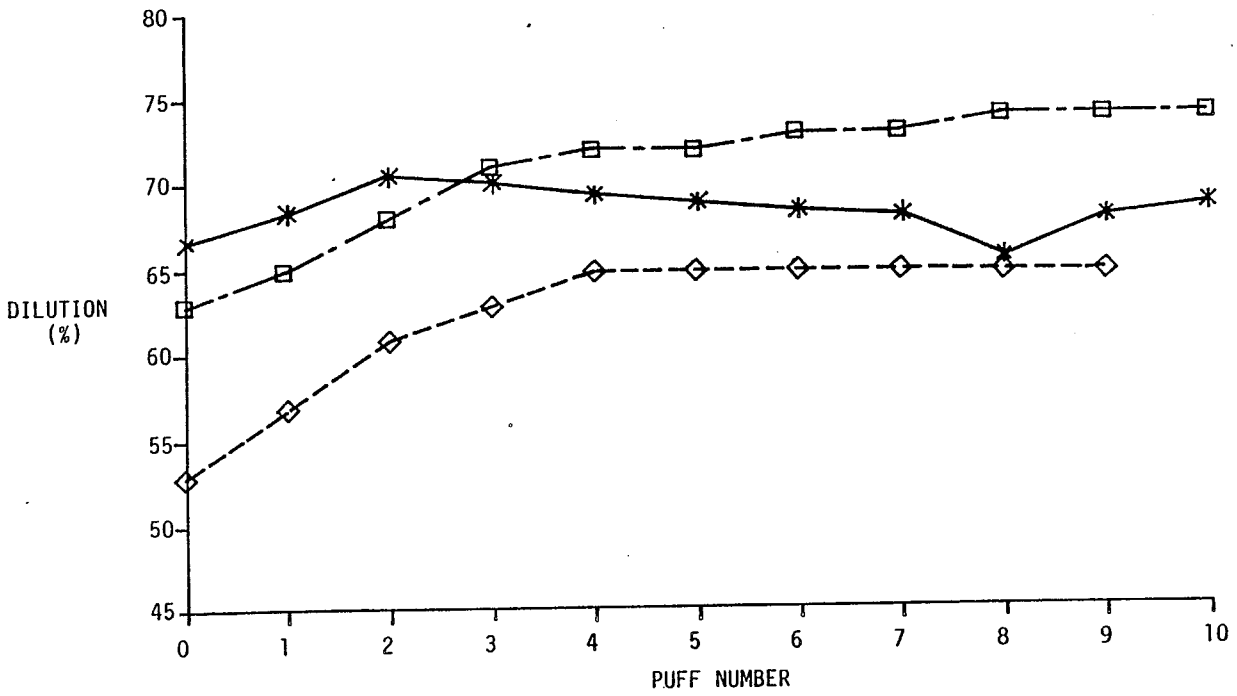
FIG. 5 shows a plot of air dilution against puff number for the cigarettes of FIGS. 3 and 4.

This can be seen from FIGS. 3, 4 and 5. In these drawings, the performance of a cigarette having a normal filter mouthpiece (unbroken line) is compared with cigarettes having filter mouthpieces according to the invention (broken and chain lines). The RTD and ventilation levels of these two mouthpieces were made different by a different choice of filter material and different porosity wrapping and overwrap, to give cigarettes having different total DPM deliveries.

FIG. 3 shows the DPM delivery against the puff number. It is the DPM delivery per puff which determines the taste to the smoker. The normal filter cigarette shows an increase in DPM delivery as smoking progresses, due the the decreased filtering effect and almost constant RTD and ventilation levels, as seen from FIGS. 4 and 5.

The cigarettes having mouthpieces according to the invention shows a DPM delivery close to the ideal constant level (a horizontal line on the graph of FIG. 3). As is seen from FIGS. 4 and 5, the dilution and the RTD increase with the puff number. The total DPM delivery can be controlled by altering the initial RTD and ventilation levels, by appropriate choice of filter materials and wrapping porosity. Total deliveries as low as 2 mg may be achieved, for example by inclusion of a second zone of perforations in the tipping, as shown in FIG. 2.

In this case, the arrangement of the filter mouthpiece can be chosen to provide an initially high DPM delivery, to enhance the taste of the first one or two puffs, dropping off to a constant DPM delivery level.

It has also been found that the CO:TPM (total particulate matter) ratio may be reduced from the normal level of about 1 to as los as 0.6–0.7 by filter mouthpieces according to the invention.

What is claimed is:

1. A filter mouthpiece for a smoking article, said filter mouthpiece comprising: a filter, said filter having a peripheral surface and two opposed end surfaces, said end surfaces being permeable to smoke and air and said peripheral surface being rendered generally impermeable to the smoke and air, one of said end surfaces being a tobacco rod end which, when the mouthpiece forms part of a smoking article, abuts a rod of tobacco, and the other of said end surfaces being a mouth end, which, in use, is held in a smoker's mouth; a tube open at both ends, the wall of said tube being substantially impermeable, said tube extending axially through said filter from said tobacco rod end thereof toward but ending short of said mouth end thereof, side wall of said tube having holes through it for the passage of smoke between said tube and said filter, said peripheral surface of the filter mouthpiece being air transmissive over at least one discrete area to admit air into said filter.

2. A filter mouthpiece of claim 1 wherein said filter comprises a tobacco rod end filter portion and a mouth end filter portion in coaxial alignment with said rod end filter portion, said tube extending axially through said rod end filter portion.

3. The filter mouthpiece of claim 2 wherein said peripheral surface of said filter is air transmissive only in the mouth end region of said tobacco rod end filter portion.

4. The filter mouthpiece of claim 2 wherein said peripheral surface of said filter is air transmissive only in the tobacco rod end and the mouth end regions of said tobacco rod end filter portion.

5. A smoking article comprising a filter mouthpiece of any claims 1 to 4.

6. The filter mouthpiece of any of claims 1 to 4 wherein said holes in said wall of said tube are arranged in opposed pairs.

7. A smoking article comprising the filter mouthpiece of claim 6.

8. A cigarette comprising the filter mouthpiece of claim 6 in axial abutment with a wrapped tobacco rod.

9. The filter mouthpiece of claim 6 wherein there are 6 pairs of said holes in said wall of said tube.

10. A cigarette comprising the filter mouthpiece of claim 9 in axial abutment with a wrapped tobacco rod.

11. A smoking article comprising the filter mouthpiece of claim 9.

12. The filter mouthpiece of claim 6 wherein there are 7 pairs of said holes in said wall of said tube.

13. A cigarette comprising the filter mouthpiece of claim 12 in axial abutment with a wrapped tobacco rod.

14. A smoking article comprising the filter mouthpiece of claim 12.

15. A cigarette comprising the filter mouthpiece of any of claims 1 to 4, in axial abutment with a wrapped tobacco rod.

* * * * *